United States Patent [19]

Schaefer

[11] 4,008,434

[45] Feb. 15, 1976

[54] ENGINE DIAGNOSTIC APPARATUS

[75] Inventor: Joseph H. Schaefer, Minnetonka, Minn.

[73] Assignee: Applied Power Inc., Milwaukee, Wis.

[22] Filed: July 30, 1975

[21] Appl. No.: 600,228

[52] U.S. Cl. ..... 324/16 S
[51] Int. Cl.[2] ..... G01R 29/00
[58] Field of Search ..... 324/15, 16 T, 16 S; 73/117.3

[56] References Cited

UNITED STATES PATENTS

| | | | |
|---|---|---|---|
| 3,650,149 | 3/1972 | Howes | 324/16 T X |
| 3,714,499 | 1/1973 | Pelta et al. | 324/16 S X |

*Primary Examiner*—Stanley T. Krawczewicz
*Attorney, Agent, or Firm*—Frederick E. Lange

[57] ABSTRACT

An engine analyzer in which testing apparatus is controlled in accordance with a signal generated from voltage pulses applied to the spark plugs, the signal being converted into a square wave voltage of a frequency corresponding to the frequency of occurrence of the ignition voltage pulses. Specifically, this is accomplished by producing a first square wave voltage of one-half the frequency of occurrence of the pulses, integrating this square wave voltage to form a first triangular wave voltage of the same frequency, inverting portions of this first triangular wave voltage to form a triangular wave voltage of the same frequency as the frequency of occurrence of the pulses and differentiating this further triangular wave voltage to form a square wave voltage of the frequency of occurrence of the pulses. The testing effect is initiated at the end of each first half cycle of the final square wave voltage so that the testing operation is initiated at a time intermediate the times at which successive voltage pulses occur.

11 Claims, 3 Drawing Figures

NO. 1
NO. 2
NO. 3
NO. 4
A
$T_{1O}$
$T_{2O}$
$T_{3O}$
$T_{4O}$
195
B
C
a
b
c
205
e
f
g
d
D
E
a'
b'
c'
d'
e'
f'
g'
F
a''
b''
c''
d''
e''
f''
g''
G
244
245
H
I
J
286
K
L
327
326
M
328
N
329

ENGINE DIAGNOSTIC APPARATUS

BACKGROUND OF THE INVENTION

In engine diagnostic apparatus it is quite common to employ a signal derived from the voltage pulses applied to the engine igniters to control the operation of testing apparatus. For example, one or more igniters may be selectively rendered ineffective and by employing a counter or some other timing device, it is possible to determine in accordance with the number of ignition pulses which cylinder would be firing at any particular time. It is also old to utilize such a signal for controlling the horizontal sweep of a cathode ray tube forming part of such an engine diagnostic apparatus. Regardless of the nature of the testing operation being performed, it is often desirable to have the testing operations start at a point prior to the occurrence of the ignition pulse being considered in the test. In the Marino U.S. Pat. No. 3,572,103 and the Marino and MacCrea U.S. Pat. No. 3,573,608, this was accomplished by deriving a signal across the distributor points and employing this signal to produce a square wave of the same frequency as the frequency of occurrence of the pulses produced by the opening and closing of the distributor points. This system worked quite well where the distributor points were readily accessible or where a connection to the primary winding at the point where it is connected to the distributor points produced a voltage accessible for use in the engine diagnostic apparatus. Where, however, inductive pickups are used or where, as is the case with electronic ignition, it is often very difficult to connect readily to any point in the system which corresponds to the connections across the distributor points, it is often necessary to connect to the secondary winding of the ignition coil. This produces a signal which indicates approximately the time that a voltage is applied to the igniter but which does not provide a ready indication of any intermediate point spaced from the ignition pulse by a predetermined portion of the cycle. Due to the wide variation in engine speed at which such testing operations must be performed, it is impossible to use the ignition pulse to generate a square wave of fixed duration and have this suitable for all engine speeds. It is hence desirable to have a voltage wave which, like that appearing across the distributor points, has a definite fixed intermediate point which occurs at a point in the cycle which is relatively constant percentagewise, regardless of the frequency of the occurrence of the ignition pulses.

Where the counter is employed, a further problem often arises. It is necessary to make sure that the counter starts its counting operation at a predetermined point in the engine cycle. Thus, it is quite common to employ the ignition signal being supplied to one particular engine igniter to generate a further pulse which in turn is used to make sure that the counter is reset at the time that an ignition signal would normally be supplied to that particular igniter. The problem that arises with this arrangement is that the connection to the ignition wire to the selected igniter may run close to other ignition wires so that a signal may be picked up from ignition wires leading to other igniters. This may result in the counter being falsely reset at the wrong time. While it has been proposed to provide an arrangement for preventing such a reset signal being supplied to the counter at a time other than that at which an ignition signal would normally be supplied to the selected plug, prior arrangements have had a disadvantage that if the diagnostic apparatus was connected to an engine which was running before the power supply for the apparatus was turned on, it would be possible to get into a situation in which the counter never was allowed to start its cycle.

SUMMARY OF THE PRESENT INVENTION

The present invention is concerned with an analyzer for multiple cylinder internal combustion engines of the type having an electrical igniter for each cylinder, electrical ignition pulse generating means and means for sequentially applying the voltage pulses generated by the pulse generating means to the various igniters, the analyzer having means for connection to the pulse generating means for deriving from it a series of voltage pulses each occurring about the time an ignition voltage pulse is applied to one of said igniters and means for generating from this series of voltage pulses a cyclically varying voltage of a frequency equal to that of the ignition pulses so that a complete cycle of the cyclically varying voltage occurs between any two such ignition pulses, this voltage being used to control the operation of testing apparatus in such a manner that a cycle of the testing apparatus is initiated near the end of a first half cycle of the cyclically varying voltage so that the testing operation is initiated at a time intermediate the times at which successive ignition pulses occur.

The production of this cyclically varying voltage is accomplished by deriving from the series of ignition pulses a first cyclically varying voltage of a frequency one-half of that of the frequency of occurrence of the pulses and producing from that a second cyclically varying voltage of a frequency equal to that of the occurrence of the pulses. Specifically, this is done by using the ignition pulses to generate a series of square waves by the use of a bistable multivibrator. The bistable multivibrator is triggered each time that a pulse is applied to its input and the square wave continues until the next pulse is received, at which time a new square wave of opposite polarity is produced which continues until the following pulse is received. This square wave voltage, as pointed out previously, has a frequency equal to one half of that of occurrence of the pulses since only one half cycle of the square wave occurs between any two successive pulses. This initial square wave voltage is run through an integrator which will produce a triangular wave form voltage of the same frequency as the first square wave voltage. Using this triangular wave form voltage, it is now possible to readily produce a triangular wave voltage of twice the frequency by running the triangular wave form voltage through a voltage doubler. This triangular wave form voltage of twice the frequency of the original, which is the same frequency as that of occurrence of the ignition pulses, can now be differentiated to produce a square wave voltage of the desired frequency.

The second square wave voltage which has a frequency the same as that of occurrence of the ignition pulses makes it possible, because it changes polarity at a point half way between the occurrence of the pulses, to control various testing equipment and have a cycle initiated at a point intermediate the occurrence of the ignition pulses. As previously explained, this is desirable for a variety of testing operations. For example, where the equipment embodies a cathode ray tube, the voltage pulses are used directly or indirectly to control the horizontal sweep of the cathode ray tube upon which is superimposed various information to be tested, which information is indicative of the condition of the igniters. For example, the voltage across any selected igniter which occurs at the time of firing of the igniter may be displayed on the screen and used to deflect the horizontal trace by an amount indicative of this voltage. In a so-called "parade display", the voltage appearing across the various igniters is successively displayed in a serial fashion so that during one sweep of the cathode ray tube, all of the voltages accompanying the firing of the successive igniters are displayed serially one after the other. In other cases, the cathode ray tube may be operated so as to produce a series of horizontal traces, one above the other, there being one trace for each particular igniter. Such an arrangement is shown in the Marino et al. U.S. Pat. No. 3,573,608, previously referred to. This type of display is often called a "Raster" display. Regardless of the type of display employed, it is obviously desirable that the trace start at some other time than the time at which the firing voltage is applied to the particular igniter. The reason for this is, as explained in the Marino et al. U.S. Pat. No. 3,573,608 is that the information which it is desired to observe is that which occurs when the firing voltage is applied to the igniter. If the trace is not initiated until the firing voltage is applied to the igniter, it is possible to have part of the desired information appear at the end of the preceding trace and part at the beginning. By having the trace start before the firing voltage actually is applied to the igniter, the information to be observed occurs well after the beginning of the trace.

Another use that can be made of the square wave voltage which has been described above is to control the operation of an arrangement for selectively rendering various igniters ineffective. One common method for testing the performance of an engine is to selectively disable various igniters and observe the effect upon the performance of the engine. If the igniter has been functioning properly, the disabling of this particular igniter will obviously result in a reduction in engine speed and this can be observed in any suitable manner such as on a tachometer. If a cathode ray tube is being employed, the reduction in voltage across the igniter terminals can be observed on the cathode ray tube. In any event, it is highly desirable that it be possible to determine which igniter would normally be effective at any given time so that it is possible to pick which igniter is being disabled and to know which one is being disabled. One method which has been employed in the past and which is disclosed in the Marino U.S. Pat. No. 3,572,103 is that of employing an electronic pulse counter which has a plurality of output stages corresponding in number to the number of cylinders. A voltage successively appears at the various output stages as the counter is advanced as a result of successive impulses being applied thereto. Again, it is desirable that the counter be advanced at a time corresponding to a time intermediate to successive ignition pulses so that the voltage appearing at the output terminal and corresponding to the firing of one particular igniter occurs at a time prior to the time that the igniter would normally have a voltage applied thereto. By utilizing the voltage of the type which I have described, it is possible to advance each stage of the pulse counter at a time prior to the time at which a firing pulse would normally be applied to any one igniter.

Where such a pulse counter is employed, I further provide means to insure that the pulse which is employed to insure the resetting of the pulse counter at the desired time, is applied to the ring counter only at the desired time. This pulse is conventionally derived from a connection to a particular selected igniter. It is possible, as pointed out previously, to have extraneous pulses generated in the connection to this one igniter. With my arrangement, the pulse counter is employed to permit a pulse from this one particular igniter to be applied only at the time when the counter is at a stage corresponding to the time at which that igniter would fire. At all other times, the means for applying a pulse to the counter as a result of a voltage pulse being applied from this igniter is rendered ineffective.

Various other objects and features of the invention will be apparent from a consideration of the accompanying specification, claims and drawing.

DESCRIPTION OF THE PREFERRED EMBODIMENT

Figure 1A:
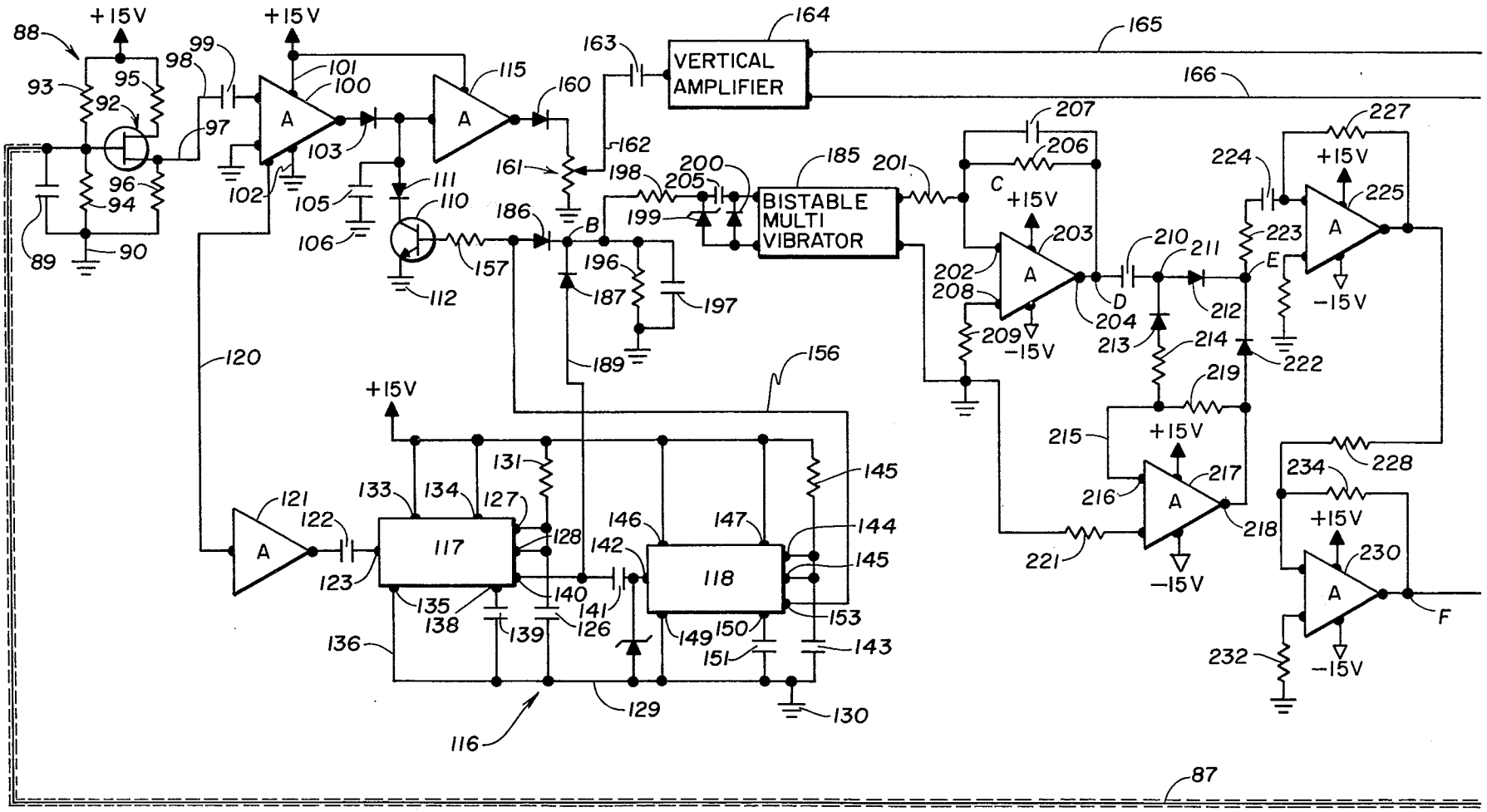
FIGS. 1A and 1B of the drawing collectively show the apparatus in schematic form, the apparatus being shown in connection with the igniters and the distributor of an electronic ignition system which likewise is shown in schematic form
Figure 1H:
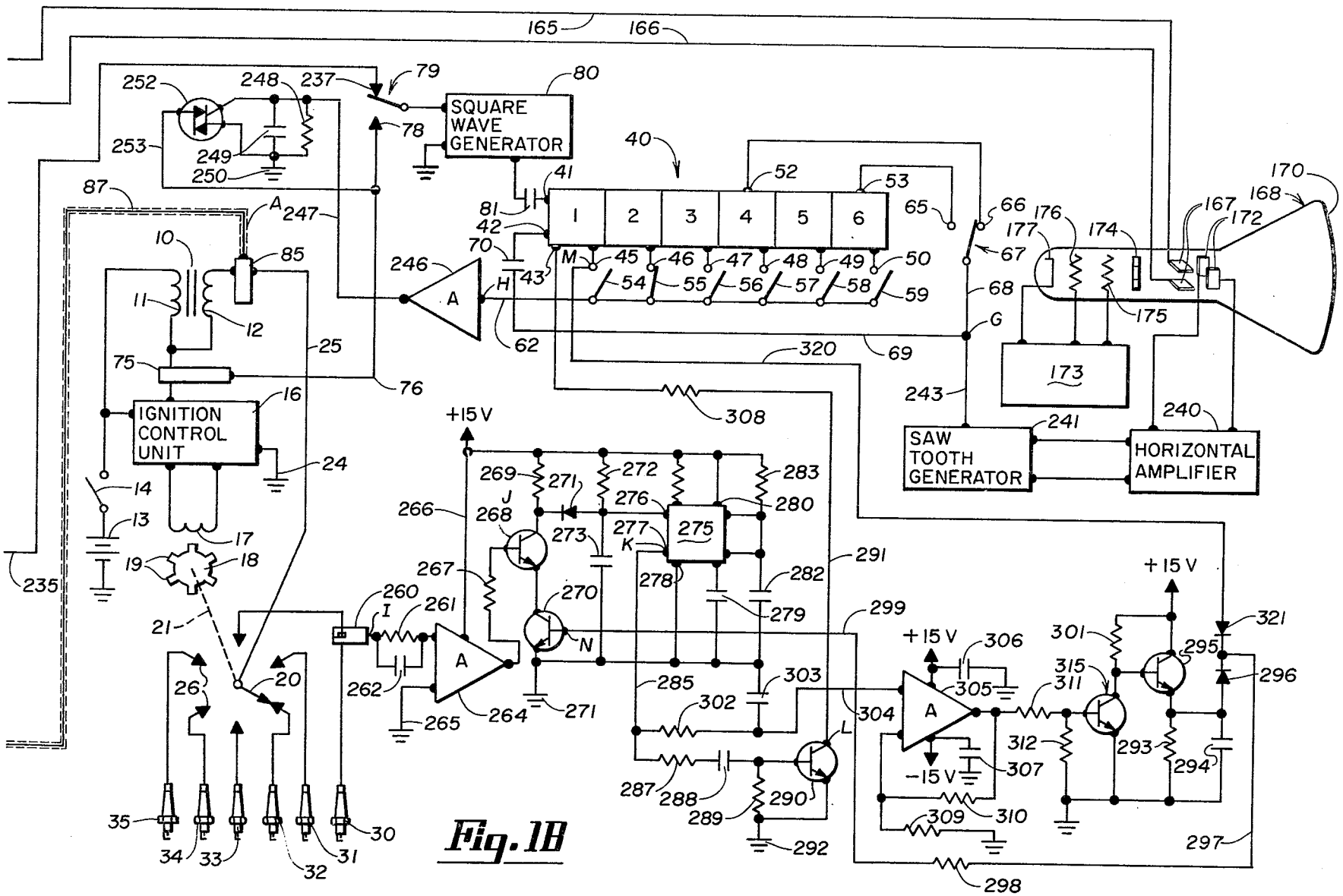

Referring to FIGS. 1A and 1B, I have shown the engine diagnostic apparatus as connected to an automobile ignition system which is schematically shown in the drawing. Referring to this automobile ignition system, which has been illustratively shown in connection with a six cylinder engine, numeral 10 indicates the usual ignition coil having a low voltage primary winding 11 and a high voltage secondary winding 12. The low voltage primary winding 11 is connected to the positive terminal of the automobile battery 13 through a switch 14 which can be the conventional "ignition" switch. Current flow from the positive terminal of battery 13 through primary 11 is controlled by an ignition control unit 16 which is in turn controlled by an inductive unit 17 cooperating with a magnetic rotor 18 having six teeth 19 corresponding to the six cylinders of the engine. For simplicity, the engine diagnostic apparatus is shown in connection with a six cylinder engine. It is understood, however, that the invention is equally usable with an engine having any conventional number of cylinders. The rotor 18 is driven by the engine along with the distributor arm 20 of the distributor 21. The rotor 18 makes one complete rotation for each complete cycle of the engine. Lobes 19 of the rotor 18 are located so as to be inductively coupled with the inductive pickup 17. As each lobe passes the inductive pickup 17, a pulse is induced therein, which pulse is transmitted to the input of the ignition control unit 16. Thus, the input of ignition control unit 16 is supplied with a series of relatively sharp pulses, one for each lobe 19 of the rotor 18. The ignition control unit is of a conventional type used in capacitive ignition systems and serves to control the operation of an electronic switch connected between the lower terminal of primary winding 11 and ground, the ground connection being shown at 24. Each time that one of the lobes 19 moves into inductive relationship with the inductive pickup 17, the ignition control 16 is effective to interrupt the circuit which may be otherwise traced from battery 13 through ignition switch 14, primary winding 11, and the ignition control 16 to ground at 24. The result of this is that there is an abrupt change in the current flowing through the primary winding to cause a high voltage to be induced in the secondary 12. In this respect, the action is similar to that of a conventional system employing points, the primary difference being that instead of a mechanical switch, an electronic switch triggered by the inductive pickoff 17 is employed. The result of this is that a series of high voltage pulses is induced in secondary winding 12. The upper terminal of secondary winding 12 is connected through a conductor 25 to the rotor 20 of the distributor 21. Rotor 20 is in turn adapted to make conductive connection with six distributor contacts 26, one for each cylinder of the engine. These distributor contacts are distributed uniformly around the distributor and are connected to six igniters 30 through 35 which are shown specifically as spark plugs. As the distributor rotor 20 moves into conductive relation with any one contact 26, a firing voltage is applied to that one of the spark plugs 30 through 35 to which that particular contact is applied. The rotor 18 of the ignition control unit and the distributor rotor are driven by the engine and are so disposed that the high voltage pulses appearing in secondary 12 occur at approximately the times that the distributor rotor 20 engages the contacts 26. Thus, as the distributor rotor rotates, being driven by the engine, a firing voltage is successively applied to plugs 30 through 35 in sequence. It is understood that each of these spark plugs 30 through 35 are associated with a different cylinder. While I have shown the spark plugs as located in a continuous row, it is to be understood that they are associated with the cylinders in such a manner as to produce the desired firing sequence. Furthermore, while I have specifically shown spark plugs, it is to be understood that other forms of igniters may be employed.

Turning now to the engine diagnostic apparatus, the reference number 40 is employed to indicate a ring counter. This ring counter has a plurality of stages equal in number to the maximum number of cylinders of any engine to be tested. For purposes of simplicity, the ring counter is shown as having six stages numbered 1 through 6 to correspond with the six cylinder engine previously referred to. It will be understood, however, that normally the ring counter would have eight stages so that the apparatus would be adapted to diagnose the conditions of eight cylinder internal combustion engines.

The ring counter 40 is basically the same as the ring counter 35 of Marino U.S. Pat. No. 3,572,103. Such ring counters are somewhat conventional and reference is made for further details of a typical such ring counter to the above mentioned Marino patent. The ring counter 40 has a normal input terminal 41 to which pulses are applied for advancing the counter from one stage to the other. The ring counter has a reset terminal 42 which serves to reset the ring counter and cause it to repeat its cycle. There is also an auxiliary reset terminal 43 which, as will be presently explained, has a pulse applied thereto at a certain stage of the engine operation to insure that the ring counter remains "in step" with the engine.

The ring counter has six output terminals, one for each of stages 1 through 6, these output terminals being connected to switch contacts designated by the reference characters 45 through 50, respectively. In addition, stages 4 and 6 have auxiliary output terminals 52 and 53. It is understood that if an eight stage counter were to be employed, there would also be an auxiliary terminal in connection with stage 8. Similarly, if the apparatus would be used for testing two cylinder engines, there would be an auxiliary output terminal at the second stage.

Associated with each of the switch contacts 45 through 50 is a switch blade, these switch blades being designated by the reference numerals 54 through 59. It is to be understood that any one of the switch blades 54 through 59 may be selectively engaged with the associated contact of the contacts 45 through 50. The switch blades 54 through 59 are all connected to a common conductor 62 and upon any one of the switch blades 54 through 59 being engaged with the associated contact, the output of the particular stage associated with that terminal is connected to conductor 62.

The auxiliary output terminals 52 and 53 are connected to contacts 65 and 66 of a switch 67, the switch blade of which is moved into engagement with either contact 65 or 66, depending upon the number of cylinders in the engine being tested at the time. The switch 67 is in turn connected through conductors 68 and 69 and a capacitor 70 to the reset terminal 42.

In operation, pulses are applied to the input terminal 41, as will be presently described, one pulse being applied each time that a firing voltage is applied to one of the igniters. The series of pulses applied to input terminal 41 causes the ring counter 40 to progressively advance from one stage to the other, causing an output voltage to successively appear on switch contacts 45 through 50 (where a six cylinder engine is being tested). When the stage corresponding to the maximum number of cylinders in the engine being tested becomes effective, the voltage appearing at the output terminal 52 or 53 is applied to reset the ring counter. In the switch position shown, the switch blade of switch 67 is connected to contact 66 which is connected to auxiliary terminal 52 associated with the fourth stage. Thus, under the conditions shown, the apparatus is designed to be employed in connection with a four cylinder engine. When an output voltage appears across stage 4, then a voltage is applied from the auxiliary output terminal 52 to contact 66 of switch 67 and through conductors 68 and 69 and capacitor 70 to reset terminal 42. Thus, under these conditions, the ring counter 40 is reset after completing four stages of operation. Stages 5 and 6 thus become inactive. If, on the other hand, the switch blade 67 is moved into engagement with contact 65, then the ring counter continues until a voltage is applied to auxiliary output terminal 53 of the sixth stage. Under these conditions, the voltage from auxiliary output terminal 53 is applied through contact 65, the switch blade of switch 67 and conductors 68, 69 and capacitor 70 to the reset terminal 42 so as to cause the counter to reset when it has completed six stages of operation.

As has been previously explained, pulses are applied to the input terminal 41 each time that a firing pulse is applied to one of the igniters. Thus, with a six cylinder engine, six pulses are applied to terminal 41 for each complete cycle of the engine. Where it is possible to connect to the primary winding 11 and where the signal from primary winding 11 is of such character as to be usable for the purpose, the signal is derived from the primary winding. A clamp-on connector 75 is attached to a terminal of primary winding 11. This direct connector makes a direct conductive connection with the primary winding and may be in the form of an alligator clip, for example. Connector 75 is connected through a conductor 76 to one terminal 78 of a switch 79, the switch blade of which is connected to the input of a square wave generator 80. This square wave generator preferably comprises a filter for filtering out any high frequency extraneous components of the primary voltage and a Schmidt trigger for converting the pulses into a square wave voltage of substantially constant amplitude, the frequency of which is equal in magnitude to the frequency of occurrence of the ignition pulses. The Schmidt trigger functions to provide one half of the square wave during the time that the ignition control unit 16 provides a conductive path to the primary winding 11 and the other half while the ignition control is blocking current flow through the primary winding 11. The output of square wave generator is fed through a capacitor 81 which functions to provide a series of sharp pulses of relatively short duration. These pulses are applied to terminal 41 and whenever a negative pulse is applied to terminal 41, the counter is advanced from one stage to the other. The counter is preferably provided with some means such as a diode, not shown, for blocking the positive pulses coming from capacitor 81. Thus, the counter advances one stage after the other each time that the ignition control unit acts to allow current flow through the primary winding. An important feature of the invention is that the stage is advanced at the time that the ignition control unit 16 allows current to flow through the primary rather than at the time when it interrupts the current through the primary. In order words, the counter is advanced at a time equivalent to "points closed" position of a conventional system. Furthermore, the counter is advanced prior to the opening of the circuit through the primary winding 11 which results in the firing of the plug related to that stage. Thus, the ring counter is actually advanced prior to the time that the ignition pulse for the related cylinder occurs. Thus, for example, the counter advances to stage 2 before the ignition pulse is applied to the igniter corresponding to that stage. In other words, a voltage is applied to the output terminal 46 of stage 2 before an igniter voltage is applied to the igniter corresponding to that stage.

In the foregoing explanation, it has been assumed that it is possible to derive from the primary winding the signal necessary to advance the counter 40. Unfortunately, as has been pointed out previously, this is not always possible. In some cases, particularly with electronic ignition systems, it is impossible to apply a conductive connection to the primary winding since the entire ignition system is housed in such a way as to prevent ready access to the terminals of the primary windings. Furthermore, with various types of electronic ignition systems, the signal from the primary winding tends to assume various forms and it is not always possible to be sure that the equipment including square wave generator 80 will be suitable for producing from such a signal a wave form suitable for use in advancing the counter. The present invention is particularly concerned with this type of situation and with obtaining a signal from the output of the secondary winding which can be used for advancing the counter and which has a definable intermediate point such that this intermediate point can be used to define the time at which the counter is advanced. As pointed out above, it is desirable to advance the counter prior to the time at which the ignition pulse is applied to the igniter.

Referring still to FIG. 1B, the reference numeral 85 is employed to indicate a quick detachable connector, which may be of the capactive type, which is connected to the conductor 25 leading from the ungrounded terminal of high voltage secondary 12 of the ignition transformer 10. The connector 85 is connected by a shielded cable 87 to the input of an amplifier stage 88 as shown in FIG. 1A. The amplifier stage 88 is designed to have a relatively high impedance input and a relatively low impedance output. The capacitor of the connector 85 forms with capacitor 89 a voltage divider. It will be noted that capacitor 89 is connected between capacitive connector 85 and a ground connection 90. Thus, a predetermined portion of the voltage appearing at the ungrounded terminal of secondary 12 will appear across capacitor 89 which is connected across the input to amplifier 88. The amplifier stage 88 comprises a field effect transistor 92. The upper terminal of capacitor 89 is connected to the gate of this field effect transistor. This gate is normally maintained at a predetermined potential by being connected to the junction of two resistors 93 and 94 which are connected between a +15 volt source and the ground connection 90. The drain electrode of the field effect transistor 92 is connected through a resistor 95 to the +15 volt source and the source electrode is connected through a resistor 96 to ground. The voltage across resistor 96 existing between the source electrode and ground is applied through conductors 97, 98 and capacitor 99 to the input terminal of a further amplifier 100. This amplifier 100 is connected to a +15 volt power source by a conductor 101 and is connected to ground by conductor 102. The output of the amplifier 100 is applied through a diode 103 to a capacitor 105 which is periodically charged to a magnitude corresponding to the magnitude of the secondary voltage which is picked up by connector 85. Because the final stage of the amplifier 100 has a relatively low impedance when conductive, when the transistor 110 is conductive the time constant of the circuit from the +15 voltage source through the diode and capacitor is extremely low to enable the capacitor 105 to be quickly charged to a voltage which is proportional to the voltage pulse of the secondary voltage. Operation of amplifiers 88 and 100 in charging capacitor 105 is described in connection with a similar circuit in the Johnston et al application Ser. No. 495,331, filed Aug. 7, 1974.

As in the aforementioned Johnston et al. application, means are provided for periodically discharging capacitor 105. This means takes the form of a NPN transistor 110 which is connected through a diode 111 in parallel with capacitor 105. It will be noted that the emitter of transistor 110 is connected to ground at 112. It will thus be readily apparent that when transistor 110 is conductive, a discharge path is provided from the upper terminal of capacitor 105 through the diode 111 and transistor 110 to ground. Until transistor 110 becomes conductive, however, the capacitor 105 has no ready discharge path. As was noted, the capacitor 105 is connected to the output of amplifier 100 through a diode 103 which effectively blocks any discharge of the capacitor 105 through amplifier 100. While capacitor 105 is connected, as will be presently explained, to the input of an amplifier 115, this amplifier is selected so as to act on an isolation amplifier to prevent any appreciable drain on the charge of capacitor 105. Thus, while capacitor 105 is very quickly charged to a magnitude corresponding to the incoming signal, the voltage across the capacitor remains substantially at this value until the transistor 110 is turned on.

The conductivity of transistor 110 is controlled by a timing circuit 116 having two stages 117 and 118. These two timing stages correspond to the two timing stages of the aforementioned Johnston et al. application. Broadly, the first timing stage is designed to provide a timing period which is very short, for example, 100 microseconds. This timer is employed to turn on the transistor 110 at the end of this very short timing period. The second timer 118 is provided for the purpose of insuring that the capacitor 105, when discharged by reason of the operation of the first timing circuit and the transistor 110, will remain discharged for a substantial period of time to minimize the possibility of the capacitor being accidentally recharged as a result of some spurious signal that occurs between the two ignition pulses which it is desired to measure.

The timing circuit 117 is controlled by a connection 120 leading from an output terminal of an intermediate stage of amplifier 100, which preferably is a multi-stage amplifier. The conductor 120 is connected through an amplifier 121 and a capacitor 122 to the input terminal 123 of the timing circuit 117. Timer 117 is preferably a typical linear integrated circuit timer of the type commercially sold as a 555 timing circuit. A typical timer of this type is the 555 unit of Signetics Corporation. It is, of course, understood that other similar timing devices can be employed. The timing period of the circuit is determined by a capacitor 126 which is connected between the discharge and threshold terminals 127 and 128 and ground. The lower terminal of capacitor 126 is connected to a ground conductor 129 connected to ground at 130. In actual practice, conductor 129 may be the grounded case of the timing circuit. The discharge and threshold terminals 127 and 128 are also connected through a resistor 131 to a +15 volt power supply. Reset terminal 133 and the power supply terminal 134 are both connected together and to this +15 volt power supply. The ground terminal 135 is connected to the ground conductor 129 through a conductor 136. The control voltage terminal 138 of timer 117 is connected through a capacitor 139 to the same grounded line 129. The function of timer 117 is to produce a series of relatively short timing periods which are initiated at the beginning of each voltage pulse derived across the secondary winding of the ignition coil 12 and at the end of which the timing period of timer 118 is initiated. As will be explained, the initiation of the timing period of timer 118 results in the transistor 110 being turned on to discharge the capacitor 105. The transistor 110 is maintained conductive for the timing period of timer 118 which, as pointed out above, is substantially longer than that of timer 117.

The timer 118, except for the longer timing period which is determined by the timing capacitor 143, is substantially the same as the timer 117. Like timer 117, the timer 118 is a 555 linear integrated circuit and may be of the type sold as the 555 unit of Signetics Corporation. The terminals 142. 144, 145, 146, 147, 149 and 150 correspond in function to the terminals 123, 127, 128, 133, 134, 135, and 138, respectively, of the unit 117. The primary difference between the two timers is the difference in value of the timing capacitors 126 and 143 and resistors 131 and 145. In a typical case, a capacitor of 0.001 microfarads was used for capacitor 126, and the resistor 131 has a resistance of 100 kilohms whereas a capacitor of 0.01 microfarads was used for capacitor 143 along with the resistor 145 of 220 kilohms. In other words, the R-C constant of timer 118 is 22 times that of timer 117. For this reason, the timer 117, in the example mentioned, had a timing period of approximately 100 microseconds whereas the timer 118 had a timing period of approximately 2.5 milliseconds.

The output terminal 140 of timer 117 is connected to the input terminal 142 of timer 118 through a capacitor 141. The function of capacitor 141 is to differentiate the timing pulses produced by timer 117 and to produce a series of positive and negative peaks. The positive peaks are by-passed through the Zener diode and the negative peaks are maintained at the Zener breakdown voltage, for example, ten volts. Thus, a series of negative peaks are supplied to the input terminal 142, each negative peak corresponding to the termination of one of the pulses from timer 117. The effect of this pulse is to initiate a positive pulse at the output terminal 153 of timer 118, which positive pulse continues for the timing period of timer 118 which, as pointed out previously, may be 2.5 milliseconds. The output terminal 153 of timer 118 is connected by conductor 156 and a resistor 157 to the base of transistor 110. The appearance of a positive pulse at the output terminal 153 of timer 118 thus results in the potential of the base of transistor 110 being raised sufficiently to cause the transistor to turn on. This will result in the establishment of a discharge path for capacitor 105, as explained in the aforementioned Johnston et al. application. The voltage across capacitor 105 will promptly drop to a very low value and will be maintained at this value as long as the transistor 110 is maintained conductive. As previously indicated, the purpose of the timer 118 is to maintain transistor 110 conductive for a timing period sufficiently large to cover much of the period between the firing of two plugs when the engine is running at a relatively low speed but sufficiently short that when the engine is operated at its normal maximum speed, the timing period is less than the timing period between the firing of two plugs. The purpose of this is to minimize the likelihood of the capacitor 105 being accidentally charged by some transient voltage, as previously explained.

The result of the circuits described above in connection with capacitor 105 is that each time that a high voltage impulse is received by the connector 85 as a result of a high voltage pulse being generated in secondary winding 12, the capacitor 105 is charged to a value corresponding to the magnitude of that voltage and then after a predetermined period of time it is discharged. Furthermore, it is maintained discharged for a somewhat longer period of time. The result is that there appears at the input to amplifier 115 a series of rectangular voltage pulses, the duration of which is constant and the magnitude of the voltage pulse received by connector 85. Thus, regardless of how short is the voltage pulse produced in the secondary, the voltage across capacitor 105 will remain for a fixed period of time. As previously explained, the amplifier 115 is designed to act as an isolation amplifier to prevent any appreciable drain on the charge of capacitor 105. The amplifier is connected to the same +15 volt source of power as is amplifier 100. The output of the amplifier is connected through a diode 160 to the resistance of a potentiometer 161 having its lower terminal connected to ground and having a movable slider 162. It will be obvious that, depending upon the position of slider 162, a selected portion of the voltage appearing at the output of amplifier 115 appears between slider 162 and ground. This voltage is in turn applied through a capacitor 163 to a vertical amplifier 164 which, in turn, has its output terminals connected through conductors 165 and 166 to the vertical plates 167 of a cathode ray oscilloscope 168 shown in FIG. 1B. The cathode ray oscilloscope is of the conventional type and comprises a cathode ray tube having the usual fluorescent screen 170, horizontal deflecting plates 172, the vertical deflecting plates 167 previously referred to, accelerating anode 174, grid 175, control grid 176, and cathode 177. The cathode is provided with any conventional means for heating the same and various voltages are applied to the various electrodes by a power supply 173, the details of which are unimportant as far as this invention is concerned. The operation of the cathode ray tube is conventional except for the manner in which the voltages to the horizontal and vertical electrodes are controlled.

In the operation of such a cathode ray tube as an oscilloscope, it is conventional to apply a sawtooth voltage between the horizontal plate 172 so that the cathode ray beam is horizontally moved from one side of the screen 170 to the other at a frequency dependent upon the frequency of the sawtooth voltage. The voltage applied from capacitor 105 through the isolation amplifier 115, the vertical amplifier 164 and conductors 165 and 166 to the vertical deflection plates 167 causes deflection of the beam in a vertical direction by an amount and at a time dependent upon the charge across capacitor 105. As previously explained, the magnitude of this charge is dependent upon the magnitude of the secondary voltage pulse of the ignition transformer 10.

The apparatus which has been described to date, while forming a portion of applicant's invention, is not directly concerned with the novel aspects of applicant's invention. Turning now to the features of applicant's invention which relate to the apparatus which has been described to date, the reference numeral 185 indicates a conventional bistable multivibrator of the type which, when triggered by the application of an input pulse thereof, assumes one of two conductive states and continues that state until a second pulse is received, at which time it assumes its other conductive state and remains there in that state until a third pulse is received. Thus, upon the application of successive pulses to such a bistable multivibrator, the output of the multivibrator is a square wave, the length of each half cycle of which is dependent upon the time between two successive pulses. The pulses applied to the input of the bistable multivibrator 185 is derived from an OR gate consisting of two diodes 186 and 187 connected together at a point designated by the letter B. Whenever a voltage is applied to either diode 186 or 187, the voltage appears at point B. Diode 186 is connected to the output terminal 153 of timer 118 by the conductor 156. The diode 187 is connected to the output terminal 140 of first timer 117 by a conductor 189. As previously explained, the timer 117 produces relatively short pulses, for example, pulses of 100 microseconds in duration. Timer 118, on the other hand, produces relatively long pulses which are 2.5 milliseconds in duration. By employing the OR gate consisting of diodes 186 and 187, a voltage pulse appears at point B beginning at the beginning of the voltage pulse at the output 140 of timer 117 and continuing until the termination of the output pulse at terminal 153 of timer 118. The reason for employing the OR gate and using the outputs from both timers 117 and 118 is that if the output from only timer 117 were employed, it would be possible with certain transient conditions to have two short pulses occurring one after the other. The effect of such multiple pulses would interfere with proper operation of the multivibrator. On the other hand, if an output pulse from timer 118 were the only one relied upon, the voltage pulse at point B would not start until the end of the timing cycle of timer 117 which, as previously explained, initiates the timing cycle of timer 118 after completion of the timing cycle of timer 117. By employing the outputs of both timers, it is assured that there is only one pulse for each secondary signal that is produced and that this pulse begins at the time that the secondary pulse first occurs as shown by the peak in curve A of FIG. 2. In other words, the pulses will take the form shown in waveform B of FIG. 2 in which each pulse 195 begins at the time of occurrence of an initial secondary voltage pulse shown in curve A. Thus the first pulse 195 will begin at time $T1_0$ and the second pulse at $T2_0$, etc. Assuming that the timing periods given above for timers 117 and 118, each pulse will be 2.6 milliseconds in duration, this figure representing the combined timing periods of timers 117 and 118. It will furthermore be noticed that the pulses 195 are all of uniform height despite the fact that in waveform A of FIG. 2, the voltage pulse from the secondary of the No. 2 plug is somewhat less in magnitude than the secondary voltage pulses in connection with the other plugs. The uniformity in amplitude of the pulses 195 is due to the fact that the magnitude of these pulses is determined by the constants of the timing circuits 117 and 118 and is not determined by the magnitude of the secondary trigger voltage applied to the input of amplifier 88.

Figure 2:
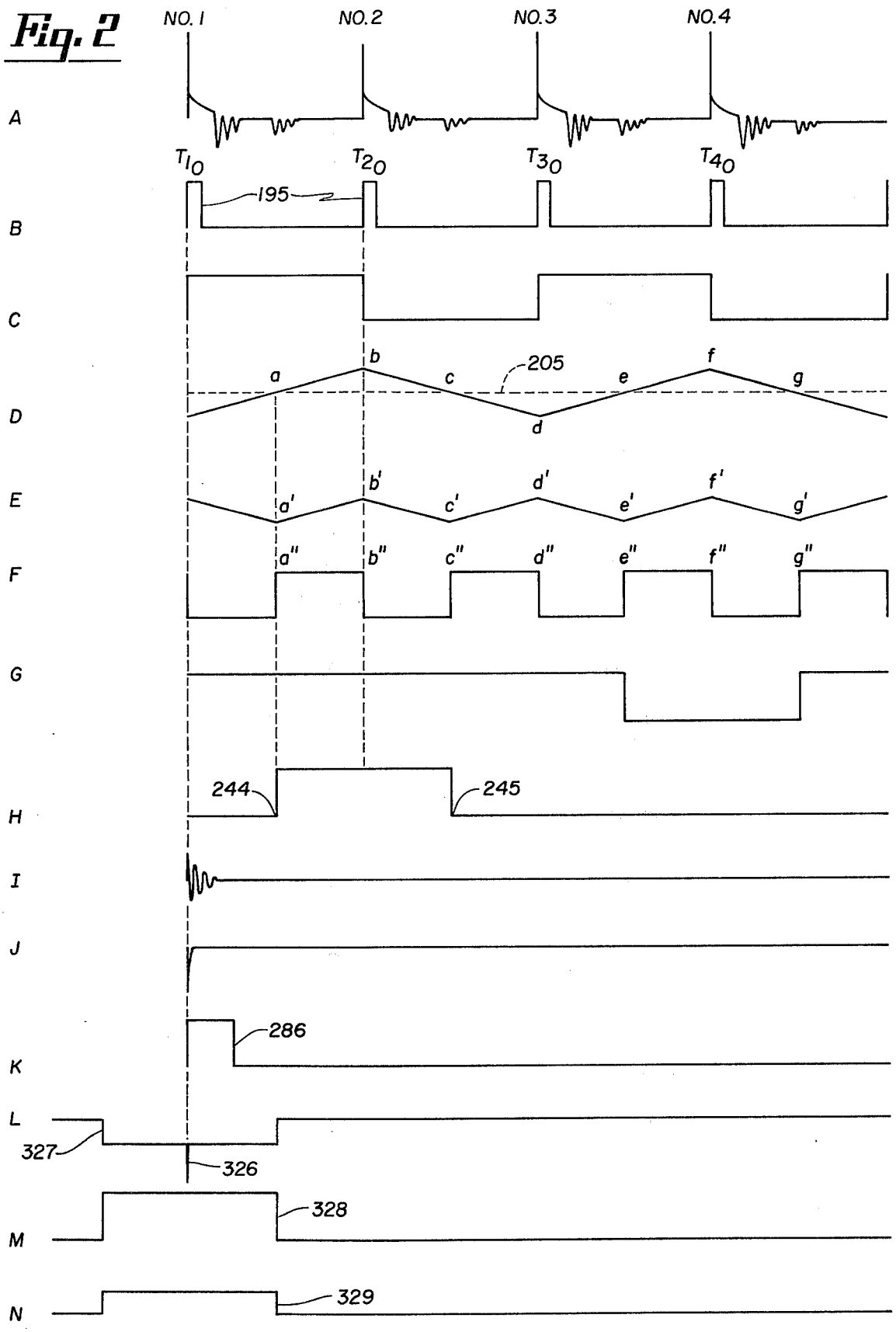
FIG. 2 is a schematic view showing various electrical wave forms at different points in the circuit.

The voltage pulses appearing at point B are applied across a resistor 196 connected between terminal B and ground. Connected in parallel with resistor 196 is a relatively small capacitor 197 to bypass any erratic high frequency signals that might be present at the terminal B. The voltage across the resistor 196 is applied through a resistor 198 to the input of the bistable multivibrator. Connected across the input terminals of the bistable multivibrator in parellel with resistor 196 and capacitor 197 is a Zener diode 199 and a further diode 200. A capacitor 206 is connected between the Zener diode 199 and diode 200. The purpose of the Zener diode 199 is to limit the magnitude of the positive voltage pulses to a predetermined value corresponding to the Zener breakdown voltage of the diode 197. The capacitor 205 differentiates the pulses applied to bistable multivibrator 185. The function of the diode 200 is to bypass the negative components of the differentiated signal. The result is that a series of positive pulses relatively free from any extraneous "hash" is applied to the bistable multivibrator 185 to cause this to produce a series of voltage pulses, each of which is initiated at the beginning of the initiation of one of the pulses 195 and is terminated at the beginning of the next pulse 195. The result will be a waveform shown at C in FIG. 2. This waveform, as will be readily apparent, is a square wave having alternate positive and negative half cycles, each half cycle of which corresponds in length to the period of time between two successive pulses 195. In other words, the square wave shown at C in FIG. 2 is a square wave having a frequency ½ that of the frequency of the pulses of the secondary ignition pulses.

The output of the multivibrator 185 is applied to junction C through a resistor 201. Junction C is in turn connected to the input terminal 202 of an operational amplifier 203 having an output terminal 204. The operational amplifier 203 is a high performance operational amplifier with high open loop gain. A typical amplifier of this type is that sold as a $\mu$ A741 operational amplifier. A typical amplifier of this type is sold by the Signetics Corporation. The amplifier 203 is connected so as to act as an integrator, having a feedback connection comprising a resistor 206 and a parallel capacitor 207 between the output terminal 204 of the amplifier and the input terminal 202. The other input terminal 208 is connected through a resistor 209 to ground as is the grounded output terminal of the multivibrator 185. The positive and negative supply terminals of the operational amplifier are connected respectively to a +15 volt source and a −15 volt source. As a result of the manner in which the operational amplifier is connected, it operates to integrate the voltage appearing at point C to produce at junction D a waveform corresponding to that designated as waveform D in FIG. 2. It will be noted that during the first positive half cycle of the waveform C, the voltage at junction D constantly increases. It reaches its maximum at the end of that half cycle of the waveform D. During the next negative half cycle of the waveform C, the voltage output at D continually decreases, reflecting an integration of a negative wave. This continues until the end of the negative half cycle at which time the output at point D continues to again rise in value. The result of all of this is that a triangular waveform is produced, this waveform again having the same frequency as that of the square wave appearing at point C. Again, this waveform has a frequency ½ of that of the pulses 195.

The current at junction D is passed through a capacitor 210 of relatively large capacitance. The effect of this is to eliminate the DC component so that the resultant current is equally disposed about a center line at ground potential. The voltage thus appearing at junction 211 is a voltage which has positive peaks above a ground center line 205 and negative peaks below this ground, the positive and negative peaks being of equal amplitude. In other words, the wave form is symmetrical about a base line 205 at ground potential. Thus the portion of the wave between points *a* and *c* is positive that between *c* and *e* is negative, that between *e* and *g* is positive, etc. The positive portions of the current are passed through a diode 212 to a point E. The negative peaks are passed through a diode 213, a resistor 214, and a conductor 215 to the input terminal 216 of an amplifier 217 connected so as to act as an inverter. The amplifier 217 like amplifier 203 is a operational amplifier quite commonly designated a $\mu$A741 amplifier. In this case, however, there is a feedback connection between the output terminal 218 and the input terminal 216 including a resistor 219, and other connections so that the amplifier operates as an inverter rather than an integrator as was the case with amplifier 203. Amplifier 217 is provided with conventional connections of its power supply terminals to a +15 volt source and a −15 volt source. The output of the amplifier 217, in the form of an inversion of the negative portions of the current at junction D, is applied through a diode 222 to the point E. The result of adding the components passed through rectifier 212 and through inverter 217 is a current having the waveform shown as waveform E of FIG. 2. It will be noted that the portion of waveform D between points *a* and *c* has been passed through rectifier 212 with no appreciable change in character. The negative portion of waveform D between points *c* and *e* has been inverted so that this is now positive with the negative point *d* now being the most positive portion of that portion of the waveform E. The result is a triangular waveform current having twice the frequency of the waveform D of FIG. 2. Furthermore, this now gives points *a', c', e'* and *g'* which mark changes in the voltage curve and which are intermediate the ignition *pulses* $T1_0$, $T2_0$, $T3_0$ and $T4_0$, etc. Furthermore, these intermediate points are approximately half way between the ignition pulses just as would be the case if the equipment was connected across the points of a conventional ignition system and the closing of the points would be used to provide reference points.

It is desirable in connection with the operation of much of the equipment to have a square wave voltage. To convert the current shown at E in FIG. 2 to a square wave voltage, the current at point E is passed through a differentiator. This takes the form of a further amplifier 225 which has its input terminal connected to point E by a resistor 223 and a capacitor 224. The amplifier 225 is similar to amplifiers 203 and 217 in that it is an operational amplifier of the type commercially sold as the $\mu$A741 amplifier. Like the other amplifier, it has its power supply terminals connected to a +15 volt source of power and to a −15 volt source. In this case, the amplifier is so connected that along with the capacitor 224 in series with the input terminal, the amplifier acts to differentiate the current appearing at point E. Connected between the output terminals and the input terminals of the amplifier is a feedback connection including a resistor 227. As a result of the differentiation, the portions of waveform E which are rising such as the portions between *a'*and *b'*, between *c'* and *d'*, and between *e'* and *f'* become positive peaks of a square wave whereas the portions which are falling such as those portions of the waveform E between *b'* and *c'*, between *d'* and *e'* and between *f'* and *g'* become negative peaks.

The output of amplifier 225 is connected to the input of a still further amplifier 230 which like amplifiers 203, 217 and 225 is an operational amplifier of the type commercially sold at $\mu$A741 amplifier. The amplifier 230 has its power supply terminals connected to a +15 volt source of power and to a −15 volt source. It also has its ground terminal connected to ground by resistor 232. There is also a feedback connection between the output terminal and the input terminal including a resistor 234. The operational amplifier is connected so as to function as a high gain amplifier to get a more sharply defined square wave output. This output appears at junction F and the output is depicted as waveform F of FIG. 2. It will be noticed that the waveform is that of a square wave having alternate negative and positive half cycles of substantially equal width, the frequency of the square wave being equal to the frequency of the ignition pulses shown in waveform A. It is now possible with this waveform to have a sharply defined point intermediate the ignition pulses. These points are indicated by the points *a''*, *c''*, *e''*, etc.

This square wave voltage may be utilized in any of various ways for controlling a testing operation in which it is desired to have a function performed at a time intermediate the firing of any two plugs. In the present example, the voltage appearing at junction F is applied through a conductor 235 to a second switch contact 237 of switch 79 (FIG. 1B) previously referred to. It wll be recalled that the switch blade of this switch is connected to the input of a square wave generator 80 which includes a filter and a means for producing a sharp square wave such as a Schmitt trigger. The output of the square wave generator 80 is connected through a capacitor 81 which differentiates the output of the square wave generator to provide a series of negative pulses at the input terminals 41 of the ring counter 40.

The operation of the ring counter is the same as has been previously described. In other words, where it is possible to connect to the primary winding 11 and where the nature of the primary signal is suitable for the purpose, it is possible to use the signal from the primary winding obtained by the connector 75 to control the square wave generator in the manner previously described. In this case, the switch blade 79 is in its lower position in engagement with the contact 78. Where, however, it is impossible to utilize the primary signal either because the connection of the primary winding is inaccessible or because the nature of the primary winding current makes it unsuitable for use in controlling the square wave generator 80, the circuit of this invention provides a means for generating from high voltage pulses derived from the secondary winding, a square wave of the same frequency as the pulses so that the end of the first half cycle of each cycle of the square wave occurs at a point intermediate the ignition pulses. This makes it possible to initiate various operations at a point intermediate of the ignition pulses, as described above. As described above, the counter is advanced from one stage to the other at the time of application to input terminal 41 thereof of a negative pulse which is supplied by the square wave generator 80 at a time preceding the firing of the particular igniter whose operation is being examined. Where the novel apparatus of this invention is being employed, the negative pulse which advances the counter occurs at points $a''$, $c''$, $e''$, $g''$, etc. In other words, the counter is advanced from one stage to the other at a time approximately half way between successive ignition pulses.

The counter 40 is employed to perform several functions. The first of these functions is to control the voltage applied to the horizontal plates 172 of the cathode ray oscilloscope 168. The voltage applied to these plates is obtained from the output of a horizontal amplifier 240 which is of conventional construction commonly employed in connection with such cathode ray oscilloscopes. This horizontal amplifier 240 is controlled by a sawtooth generator 241 which, as is customary with cathode ray oscilloscopes, generates a sawtooth wave form which in turn is amplified by horizontal amplifier 240 and applied to the horizontal deflection electrodes 172. As the sawtooth wave increases in magnitude, the beam of the cathode ray tube is gradually deflected from one side to the other. When the sawtooth wave form reaches its maximum value and drops down to its initial value at the end of each of its cycles, the beam quickly returns to its original position. In actual practice, a blanking mechanism is employed to prevent the beam from being visible while moving back to its initial starting position. Such blanking mechanism, is however, no part of the present invention and since it is quite common, it will not be described herein.

In order for the voltages applied to the vertical electrodes 167 to be applied at the proper portion of the sweep of the beam, it is necessary to trigger the sawtooth generator from a signal having a time relation to the signal being measured which, in the present instance, is shown as being the voltage across the secondary winding 12. In the present instance, the output of the last stage of the ring counter 40 is utilized for this purpose. As has been previously explained, the switch 67 is moved into engagement with either contact 65 or contact 66 depending upon whether the engine being tested is a six cylinder engine or a four cylinder engine. The net result is that before an igniting would normally have been applied to the igniter of the last cylinder in the firing sequence, a voltage pulse appears on conductor 68. This voltage pulse is previously described as being employed to reset the ring counter and start it on a new cycle. Conductor 68 is, however, also connected through the conductor 243 to the input terminal of the sawtooth generator 241. The waveform appearing on conductor 68 at the point G which constitutes the junction of conductors 69 and 243 is shown in FIG. 2 by the waveform represented by the letter G. It will be noted that this waveform remains at a constant value until a point corresponding to the point $e''$ of waveform F. This is a point just prior to the time that the No. 4 cylinder will have an igniting voltage applied thereto. At this point, the voltage G drops abruptly and remains at a new low value until point $g''$ which as will be noted from the waveform A is a point after the firing of the igniter of the No. 4 cylinder has been completed. The sawtooth generator is so designed that when a negative voltage of the type just described in connection with waveform G is applied thereto, the cycle of the sawtooth generator is initiated.

Where, as is the example shown in the present drawing, the ignition pulses are shown in a "parade" display, the sawtooth generator will continue to increase its voltage output throughout the complete cycle of the engine. In a "parade" display, the outputs of the successive igniters are shown one after the other in a continuous sweep of the trace across the screen of the cathode ray tube. Such a "parade" display is desirable for certain testing purposes because it enables a ready comparison of the height of successive secondary voltage pulses. Where any one voltage pulse is, for example, relatively low, this indicates a malfunctioning of the igniter. For example, in the case of a sparkplug, it may mean that the sparkplug gap is partially shorted due to an accumulation of conducting material such as carbon on the sparkplug electrode. Thus, in a so-called "parade" display, the initiation of the sawtooth wave occurs, as previously noted, at point $g''$ and continues until this point is reached again. At this point, the sawtooth generator causes the voltage to drop to zero and to start rising again.

It will be noted, however, that the cycle of the sawtooth waveform starts at a point intermediate the points at which the No. 4 and No. 1 igniters are fired. Thus, it is possible to observe the complete voltage pulse resulting from the firing of the igniter for the No. 1 cylinder. Where, as with some prior systems, the cycle of the sawtooth generator is initiated at the time of the voltage pulse, some of the information being observed will occur at the end of one trace and at the beginning of another trace. With the present invention, however, the horizontal trace begins prior to the application to the igniter of the firing voltage so that it is possible to observe the complete secondary voltage pulse without interruption.

Another function of the ring counter 40 is to control the selective disabling of various igniters. As has been pointed out previously, one of the very important methods of testing an internal combustion engine is to selectively disable the igniters of different cylinders and then to observe the effect upon the engine operation of disabling that particular igniter. This process is repeated until each igniter has been disabled. In some cases, it is also desirable to disable groups of igniters at the same time. Such a method of testing an engine is described in the aforesaid Marino U.S. Pat. No. 3,572,103. As is pointed out in that patent, it is desirable that the igniter for any particular cylinder be disabled prior to the time that an igniting voltage would normally be applied to that igniter.

Referring to FIG. 1B, it has been previously pointed out that as successive pulses are applied to the input terminal 41 of ring counter 40, a voltage will successively appear at the output terminals of the various stages connected to switch terminals 45 through 50. Depending upon which of the switches 54 through 59 is closed, the voltage of any one of these stages is applied to conductor 62. For purposes of illustration, I have shown the switch blade 55 as being in engagement with the switch contact 46 so that whenever an output voltage appears at stage 2, corresponding to cylinder No. 2, this output voltage is applied to the conductor 62. At all other times, no voltage is applied to conductor 62. The waveform which results when switch blade 55 is closed is shown by waveform H. of FIG. 2. This represents the voltage which appears at junction H of FIG. 1B. Referring to waveform H of FIG. 2, it will be noted that the voltage level remains relatively low until the point 244 is reached. At this time, the voltage jumps abruptly. Point 244 corresponds to point a in waveform D. In other words, point 244 occurs at a point intermediate the ignition pulses of cylinders No. 1 and No. 2. The increase in voltage which occurred at point 244 continues at a uniform value until a point 245 is reached at which time the voltage drops abruptly back to its original level and remains at that level for a complete engine cycle. Thus, the effect is that there is a positive pulse which starts at a point well prior to the firing of the No. 2 cylinder and continues until a point subsequent to the firing of the No. 2 cylinder. If this signal were derived from the voltage across the distributor points of a conventional ignition system, the pulse would start at approximately the points closed position and would continue until the next points closed position.

The voltage appearing at point H is amplified through any typical amplifier 246 and is applied through a conductor 247 across a resistor 248 connected between the gate electrode of a Triac 252 and ground. Connected in parallel with resistor 248 is a capacitor 249 which serves to bypass any high frequency transient voltages. The Triac 252 is of a conventional type having two anodes and two cathodes connected in parallel with each other and oppositely disposed so as to be bidirectionally conductive when the proper voltage is applied to the gate electrode. The anodes and cathodes of the Triac 252 are connected across the ignition control unit 16 so that when the Triac 252 is conductive, the ignition control unit 16 is ineffective to interrupt the current through primary winding 11 to produce a voltage pulse. It will be noted that one of the primary electrodes of Triac 252 is connected through conductors 253 and 76 to the connector 75 which, as previously explained, is conductively connected to one terminal of the ignition control unit and the primary winding 11. The other primary electrode of the Triac is connected to ground at 250. Thus, as previously explained, whenever a voltage is applied to the gate electrode of Triac 252, the Triac becomes conductive to render the ignition control unit ineffective and hence to prevent the application of a voltage to the igniter which would normally be energized at that time.

Now referring back to the ring counter 40 and the voltage H which results from the closure of switch blade 55, it will be apparent that when the pulse of voltage H occurs, a voltage is applied through the amplifier 246 and conductor 247 to the gate of Triac 252 to render the Triac conductive and disable the ignition control unit. The effect of this, considering that switch 55 is the one that is closed, is that for a period of time prior to the time at which the igniter of cylinder No. 2 would normally be energized and continuing until sometime subsequent to the time at which the igniter would normally be energized, the ignition control unit is rendered ineffective. It is now possible by observing the effect on the engine speed either through observing a tachometer or a reading of a dynamometer or any other suitable means to determine what, if any, effect the disabling of the igniter for the No. 2 cylinder had on the performance of the engine. If the engine performance is relatively unaffected by the disabling of the igniter for the No. 2 cylinder, then it is readily apparent that the No. 2 cylinder is not functioning properly due to a faulty igniter or for mechanical reasons. If, as is normally the case, the engine speed or output drops while the No. 2 cylinder is disabled, then the person performing the diagnosis knows that the No. 2 cylinder is not the source of the trouble.

While I have shown only one switch 55 as being closed, it will be appreciated that any other switch may be closed whenever it is desired to test any other cylinder. In actual practice, the switches 54 through 59 will be successively closed to observe successively the effect of disabling the igniters of the various cylinders of the engine. If desired, several of the switches 54 through 59 may be closed simultaneously to observe the effect of disabling any particular group of cylinders. In any event, it will be noted that the disabling action occurs well prior to the time that voltage would normally be applied to the igniter or igniters being disabled so that there is no likelihood of one of the igniters being partially affected prior to being disabled.

Reference has been made to resetting the ring counter from a signal obtained when the last cylinder is at a stage where the igniter is about to be fired so that the ring counter functions as a true ring counter in constantly repeating its cycle. As will be recalled, this is done by a signal derived from either terminal 52 or 53 depending upon whether the engine being tested is a four cylinder or a six cylinder engine. In addition to this reset signal, it is desirable to have a signal for ensuring that the ring counter is reset at the time when one particular cylinder is at a stage where its igniter would normally be energized. The reason for this is that it is desirable to keep the ring counter synchronized with the operation of the engine and it is always possible for the ring counter to get out of step. Consequently, it is desired to obtain a signal associated with one particular igniter, normally the igniter for the No. 1 cylinder, and use this signal to make sure that the ring counter is reset when that particular igniter is being energized. The problem with this, however, is that the connection leading from the ignition lead for that particular igniter may run parallel to other ignition leads and there may be some capacitive or inductive pickup on the lead of the test equipment which occurs when other plugs or igniters are being energized. This may result in the counter being falsely reset. The present invention contemplates means for ensuring that the reset means from the selected plug is rendered ineffective except for the short period of time during which a voltage is being applied to the igniter for the selected plug.

Referring to the drawing and particularly to FIG. 1B, clamp-on connector 260 surrounds the ignition lead extending from the plug 30 to the associated distributor terminal 26. Plug 30 is the No. 1 plug in that it is the first in the firing sequence to have an igniting voltage applied thereto. The connector 260 is preferably an inductive connector which has a voltage induced in a coil thereof each time a firing voltage is applied to the plug 30. This voltage pulse is shown in waveform I of FIG. 2. It will be noted that there is an initial peak voltage followed by an oscillatory discharge. This voltage is transmitted through a resistor 261 and a parallel capacitor 262 to the input of an amplifier 264. The effect of the capacitor 262 is to sharpen the voltage pulse picked up by the connector 260. The function of resistor 261 is to attenuate the signal received by the pickup prior to its being applied to the amplifier 264. The amplifier 264 is primarily supplied for impedance matching and has its power supply terminal connected through conductor 266 to a +15 volt source. It also has a ground terminal connected to ground at 265. The output of amplifier 264 is applied through a resistor 267 to the base of a transistor 268, the emitter and collector circuit of which are connected in series with a resistor 269 and the emitter collector circuit of a second transistor 270 between the +15 volt source of power and ground at 271. Both transistors 268 and 270 are NPN transistors. When transistor 270 is conductive, a voltage pulse received by the pickup 260 and transmitted through the amplifier 264 results in the positive voltage being applied to the base of transistor 268 to turn on the transistor 268 and cause a current flow from the +15 volt power source through resistor 269 and the collector-emitter paths of transistors 268 and 270 to ground. This will result in a voltage drop across resistor 269 in the form of a sharp negative pulse shown in the waveform J of FIG. 2. This pulse is transmitted through diode 271 to resistor 272 connected between the +15 volt source and ground in series with a capacitor 273. The voltage across capacitor 273 is applied to the input terminal 276 of a linear integrated timer circuit 275. This timer circuit may be of the conventional type sold as a 555 integrated circuit and is connected so as to operate as a monostable multivibrator. This is one of the standard manners in which a 555 integrated circuit may be connected. The power supply terminal 280 of this amplifier 275 is connected to the +15 volt power source and the control voltage terminal is connected to ground through a capacitor 279. Ground terminal 278 is likewise connected to ground. The threshold and discharge terminals of the amplifier are connected together and to the junction of a capacitor 282 and resistor 283 which are connected in series between the power supply and ground. The capacitor 282 and the resistor 283 form an RC circuit and determine the length of time during which the voltage appearing at output terminal 277 will remain after a trigger voltage is applied to the input terminal 276. In other words, capacitor 282 and resistor 283 determine the time period of the flip-flop circuit of the multivibrator 275. The result will be that there appears at the output terminal 277 a square wave pulse which is initiated at the time that a signal is received from the pickup connector 260 as a result of a firing voltage being applied to plug 30 and which terminates at the end of the timing period determined by capacitor 282 and resistor 283. This pulse is shown as pulse 286 of the wave form shown as K in FIG. 2. It will be noted that this pulse begins at the time that the ignition pulse is picked up by the connector 260. Or, in other words, this pulse of wave form K begins at the same time as the ignition pulse, being initiated by the sharp negative peak of wave form J with the initiation of the ignition voltage applied to plug 30. The pulse 286, after being initiated by the pulse of wave form J, remains for a period of time dependent upon the time constant of the monostable multivibrator. This pulse is applied through a conductor 285, a resistor 287 and a capacitor 288 across a resistor 289 which in turn is connected between the base and emitter of an NPN transistor 290. The capacitor 288 acts to differentiate the pulse 286 to produce a sharp positive pulse which is applied to the base of transistor 290. The transistor 290 is connected in series with the auxiliary reset terminal 43 of the counter 40 through a conductor 291 and a resistor 308. It will be noted that the emitter of transistor 290 is connected to ground at 292. Thus, whenever the transistor 290 becomes conductive, the potential at the reset terminal is abruptly lowered since there is a relatively low impedance path between this reset terminal and ground. This will insure that the ring counter is reset, regardless of when the voltage is being applied to the main reset terminal 42. In other words, the effect of picking up the signal from the lead to the number one plug, after modification thereof by transistor 268, monostable multivibrator 275, condenser 288 and the associated circuitry, is to insure that whenever the igniter 30 is having a firing voltage applied thereto, the ring counter will be at the beginning of its cycle. In other words, if the ring counter should get out of step in any way, it is brought back into step by the apparatus just described.

As pointed out previously, one of the problems in connection with an arrangement such as that which has just been described is that the connection between the connector 260 and the amplifier 264, while appearing relatively short in the drawing, must be in the form of a relatively long lead to enable the test apparatus to be at a convenient location and still enable connection to the ignition lead leading to the number one igniter. Because of this relatively long connection, it is quite possible for the lead also to pick up signals from the ignition current flowing to other igniters. This would result in false resetting of the ring counter. Thus, as indicated above, I have provided means for insuring against this happening. Furthermore, the arrangement which I employ, as will be clear later, is effective even though the equipment is hooked up to an engine which is running before the power supply for the equipment is turned on. In certain prior arrangements for performing this function, the counter would never get started if the equipment were hooked up to an engine which was running before the power supply was turned on. Very briefly, I accomplish this function by preventing the signal from being transmitted from the number one igniter to the reset terminal, after the engine gets up to speed, except during the time that there is an output signal from the number one stage of the counter.

Referring back to the circuitry which has been described previously, it will be recalled that the operation of transistor 268 is dependent upon transistor 270 being conductive. In other words, the emitter-collector circuit of transistor 270 is connected in series with the emitter-collector circuit of transistor 268 and unless transistor 270 is conductive, no current can flow through the emitter-collector circuit of transistor 268 and hence no current can flow through resistor 269. Hence, in order for a signal to be transmitted from the connector 260 to the multivibrator 275, it is necessary for transistor 270 to be conductive. These circuits will be presently described.

When the engine is not running, current flows from a +15 volt power source through the collector-emitter circuit of an NPN transistor 295 and a resistor 293 to ground. A capacitor 294 is in parallel with resistor 293 and acts as a filter capacitor to by-pass any high frequency pulses. The voltage across resistor 293 is applied to the base of transistor 270 through a diode 296, a conductor 297, a resistor 298, and a conductor 299. Until the engine is running, the transistor 295 is maintained conductive through a connection, including resistor 301, between the +15 volt power source and the base of the transistor. As soon, however, as the engine speed exceeds a predetermined value, transistor 295 is rendered non-conductive, as will be presently explained.

Connected between the output terminal 277 of integrated timer 275 and ground are a resistor 302 and a capacitor 303. Each time that a pulse 286 is produced at the output terminal K (see wave form K of FIG. 2) current passes through resistor 302 and capacitor 303. The result is that for each cycle of the engine, the capacitor becomes further charged at a rate dependent in part upon the time constant of the circuit constituted by resistor 302 and capacitor 303. The lower or positive terminal of capacitor 303 is connected through a conductor 304 to the non-inverting input terminal of an amplifier 305 which, like amplifiers 203, 217, 225 and 230, is a $\mu$A741 operational amplifier. The power supply terminals of the amplifier are connected to +15 volt and −15 volt sources of power. A capacitor 306 is connected between the +15 volt source of power and ground. Similarly, a capacitor 307 is connected between the power terminal connected to the −15 volt source of power and ground. These capacitors are provided to eliminate any possible spurious signals that might be introduced by reason of the connections to the sources of power. A feedback resistor 310 is connected between the output terminal of amplifier 305 and ground in series with a resistor 309. The junction of resistors 310 and 309 is connected to the inverting input terminal of the amplifier. The gain of the amplifier is determined by the ratio between the values of resistors 310 and 309.

There is a relatively high impedance discharge path for the capacitor 303 through resistor 302, conductor 285 and the internal connections between output terminal 277 of timer 275 and the ground connection 278. Thus, the capacitor 303 is normally maintained discharged. As the speed of the engine increases, however, with a resultant increase in the frequency of the pulses 286 applied to capacitor 303, the voltage across capacitor 303 rises to the point where the output voltage of amplifier 305 reaches its maximum value. In other words, the amplifier 305 becomes saturated.

The output of amplifier 305 is applied through a resistor 311 across a resistor 312 which in turn is connected between the base and the emitter of an NPN transistor 315. As soon as the output of amplifier 305 rises above a particular value as a result of the speed of the engine reaching a predetermined value, the voltage across resistor 312 and hence between the base and the emitter of transistor 315 is sufficiently high to cause transistor 315 to become conductive. This, in turn, will cause the base of transistor 295 to be connected to ground through the collector emitter path of transistor 315. This will cause transistor 295 to be turned off so that there is no longer a current flow therethrough through the resistor 293 to ground. The result is that a voltage no longer exists across resistor 293 to be applied through diode 296, conductor 297, and resistor 298 to the base of the transistor 270. Thus, transistor 270 becomes non-conductive and since this is in series with transistor 268, it is no longer possible for the amplified pulse from the ignition lead of igniter 30 to be applied to the input of timer 275 and hence no signal is supplied from the output terminal 277 of timer 275 through resistor 287, capacitor 288 and transistor 290 to the reset terminal 43 of the counter 40.

When, however, the output voltage appears on stage 1, that is, beginning prior to the time that the number one igniter would fire, the output voltage from stage 1 is applied through a conductor 320, a diode 321, conductor 297, resistor 298 and conductor 299 to the base of the transistor 270 to again cause this to become conductive. This conductive condition exists only while there is an output from stage 1. The output pulse from stage 1 is shown by pulse 328 in the wave form M of FIG. 2. It will be noted that this pulse starts well prior to the ignition pulse $T1_0$ of wave form A and continues to an intermediate point corresponding to point a of wave form D. In other words, the pulse 328 continues for substantially a half cycle, the midpoint of the pulse being substantially aligned with the beginning of the ignition pulse. It is this pulse which is applied, as explained above, through diode 321 and resistor 298 to the base of transistor 270 to render it again conductive and permit the voltage pulse picked up by the connector 260 clamped around the ignition lead leading to igniter 30 to be applied to the reset terminal 43. The voltage applied to the base of transistor 270 from the output stage 1 of counter 40 is shown in wave form N of FIG. 2. It will be noted that this wave form is the same in duration but is less in amplitude due to the fact that the voltage appears between the base and emitter of transistor 270 which are now conductive. Hence, the voltage drop is substantially reduced and the magnitude of pulse 329 of wave form N is substantially less than that of pulse 328 of the wave form M.

Referring back for the moment to wave form L of FIG. 2, this wave form shows the pulse that is actually applied to reset terminal 43. There is a negative pulse 327 of somewhat low amplitude, this pulse occurring by reason of the fact that the voltage at terminal 43 is reduced during the reset period by reason of the internal circuitry of the counter 40. At about the midpoint of pulse 327, the pulse resulting from the output of timer 275 and the differentiation by capacitor 288 results in a sharp negative pulse 326 which is the pulse which actually performs the reset action. This pulse can occur only during the period when an output appears on the output terminal of stage 1 of the counter. At least, such an output pulse can occur only during this period after the engine comes up to speed. Prior to the time that the engine comes up to speed, the transistor 270 is maintained conductive by reason of this drop across resistor 293 resulting from current flowing from the +15 volt source through transistor 295 and resistor 293. As soon, however, as the engine comes up to speed, this transistor is rendered non-conductive as described above and it is only when an output is received from the first stage of the counter 40 that transistor 270 is conductive and hence in a condition where the signal received from the ignition lead to the igniter 30 can be transmitted through to the reset terminal 43. At all other times, any signal which may be picked up on the connection to the connector 260 is substantially blocked so that it is not transmitted through to the reset terminal. It is only during the period of the pulse 328 of wave form N that a reset signal derived from the connection with the lead to igniter 30 can be transmitted to the reset terminal 33.

It will furthermore be noted that, contrary to prior equipment designed for this purpose, the equipment will work even if it is hooked up to an engine which is running before the power supply for the equipment is turned on. This is true because even though pulses are being received periodically from the conductor leading to igniter 30, the output of amplifier 305 does not immediately rise to a value to turn on transistor 315 and hence disable transistor 295. This is due to the fact that it takes a number of pulses derived from the connector 260, regardless of engine speed, before the capacitor 303 is charged sufficiently to saturate amplifier 305. Thus, a signal continues to be applied for a short period of time from across resistor 293 through diode 296, to maintain transistor 270 turned on. The result of it is that the pulse received from connector 260 when an igniting voltage is applied to igniter 30 is effective to cause a voltage to be applied to the reset terminal 43 to bring the counter in step. Thereafter, the apparatus will operate as described above to permit the voltage pulse received from the lead extending to igniter 30 to be transmitted through to the counter only during the period of time when the output voltage appears at the first stage of the counter.

CONCLUSION

It will be seen from the above that I have provided diagnostic equipment in which it is possible to provide a voltage of the same frequency as that of the ignition pulses even though it is impossible to connect across the distributor points as has been done in the past. This is done by generating a square wave voltage of the frequency of occurrence of the ignition pulses, the apparatus being operative regardless of the speed of the engine so as to provide a marked change of voltage in between occurrences of ignition pulses. By reason of this generated voltage of the same frequency of that of the ignition pulses, it is possible to utilize the change in voltage occurring at the end of each half cycle of this generated voltage to initiate a testing action which should begin prior to the occurrence of a particular ignition pulse.

It will further be seen that where a ring counter is employed under the control of the generated voltage referred to above, it is possible with my circuit to reset this ring counter from a signal accompanying the firing of one particular igniter while insuring that any extraneous signals picked up on the connection to the ignition lead for this one igniter are ineffective to affect the resetting of the counter except during the period of time when the ingition pulse would normally be applied to that igniter.

While I have shown a specific embodiment of my invention for purposes of illustration, it is understood that the scope of the invention is limited solely by that of the appended claims.

I claim:

1. An analyzer for multiple cylinder internal combustion engines of the type having an electrical igniter for each cylinder, electrical ignition pulse generating means, and means for sequentially applying the voltage pulses generated by said pluse generating means to said igniters, said analyzer comprising:

a connector for connection to said generating means for deriving therefrom a series of voltage pulses each substantially coincident with the application of a voltage pulse to each of said igniters, first means connected to said connector for producing a first cyclically varying voltage of a frequency one-half of that of the frequency of occurrence of said pulses with each half cycle of the voltage beginning substantially at the time of occurrence of one of said pulses and terminating substantially at the time of the next of said pulses, second means connected to the output of said previously named means for producing from said first cyclically varying voltage, a second cyclically varying voltage of a frequency twice that of said first voltage so that a complete cycle of said second voltage occurs between two such voltage pulses and such that the end of the first half cycle occurs approximately midway between two such voltage pulses, testing apparatus connected to said connector for determining the operation of the engine while the engine is at various points in its cycle at which voltage pulses are normally applied to said igniters, and circuit means connected to said second means for initiating a cycle of said testing apparatus near the end of a first half cycle of said second cyclically varying voltage so that said testing operation is initiated at a time intermediate the times at which successive voltage pulses occur.

2. The analyzer of claim 1 in which both said first and second cyclically varying voltages are square wave voltages.

3. The analyzer of claim 2 in which said second means comprises means for integrating said first square wave voltage to form a first triangular wave voltage of the frequency of said first square wave voltage, and inverter for inverting portions of said first triangular wave voltage to form a triangular wave voltage of twice the frequency of said first triangular wave voltage, and means for converting said second triangular wave voltage to a second square wave voltage of the frequency of said second triangular wave voltage.

4. The analyzer of claim 1 in which said circuit means includes an electronic counter which is advanced at the end of each such first half cycle of said square wave voltage.

5. The analyzer of claim 4 in which said testing apparatus is controlled by said counter and includes means for rendering any selected igniter ineffective and for observing the effect on engine operation of said igniter being rendered ineffective.

6. The analyzer of claim 4 in which there is means responsive to the application of an ignition voltage pulse to one of said igniters for producing a further voltage pulse each time that such an ignition pulse is applied to said igniter, means responsive to the further voltage pulses for controlling said counter to insure that the same is reset where one of said further pulses is produced, and means controlled by said counter for preventing production of said further pulses except when said counter is at a counting stage corresponding to the time an ignition pulse would normally be applied to said one igniter.

7. The analyzer of claim 6 in which said means controlled by the counter comprises disabling means for preventing operation of said further voltage pulse producing means and means for preventing operation of said disabling means until the engine comes up to a minimum speed and thereafter only when the counter is at said stage corresponding to the time an ignition pulse would normally be applied to said one igniter.

8. The analyzer of claim 1 in which said testing apparatus includes a cathode ray tube having a display screen, means for producing a substantially horizontal trace on said screen each time that a voltage pulse is applied to one of said igniters, means responsive to conditions of said ignition system associated with the application of voltage pulses to said igniters for variably displacing said horizontal trace in a vertical direction to indicate the character of said conditions, and in which said circuit means includes means for initiating said horizontal trace at the end of a first half cycle of said second cyclically varying voltage.

9. The analyzer of claim 8 in which said circuit means includes an electronic counter which is advanced at the end of each such first half cycle of said square wave voltage and in which a selected output of said counter is employed to initiate said horizontal trace.

10. The analyzer of claim 1 in which said first means includes a monostable multivibrator which produces a first square wave voltage formed of square wave pulses which are initiated at the time of occurrence of one of said voltage pulses and which is terminated at the occurrence of the next voltage pulse.

11. The analyzer of claim 3 in which the means for converting said second triangular wave voltage to a second square wave voltage comprises a differentiator.

* * * * *

UNITED STATES PATENT OFFICE
CERTIFICATE OF CORRECTION

PATENT NO. : 4,008,434

DATED : February 15, 1977

INVENTOR(S) : Joseph H. Schaefer

It is certified that error appears in the above-identified patent and that said Letters Patent are hereby corrected as shown below:

Title Page - Correct the date of issue from

- Feb. 15, 1976 - to Feb. 15, 1977.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*